US007559357B2

(12) United States Patent
Clem

(10) Patent No.: US 7,559,357 B2
(45) Date of Patent: Jul. 14, 2009

(54) FRAC-PACK CASING SAVER

(75) Inventor: Nicholas J. Clem, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 169 days.

(21) Appl. No.: 11/586,235

(22) Filed: Oct. 25, 2006

(65) Prior Publication Data

US 2008/0099194 A1 May 1, 2008

(51) Int. Cl.
*E21B 43/04* (2006.01)

(52) U.S. Cl. ..... 166/51; 166/278

(58) Field of Classification Search ..... 166/386, 166/319, 325, 332.8, 278, 51, 326
See application file for complete search history.

(56) References Cited

U.S. PATENT DOCUMENTS 1,854,518 A * 4/1932 Little ..... 137/516.15
1,980,632 A * 11/1934 Peeples ..... 166/278
2,224,538 A * 12/1940 Eckel et al. ..... 166/278
2,257,765 A * 10/1941 Scaramucci ..... 166/222
6,235,192 B1 * 5/2001 Melfi et al. ..... 210/136
2002/0117301 A1 * 8/2002 Womble ..... 166/278
2004/0074641 A1 * 4/2004 Hejl et al. ..... 166/278
2007/0034377 A1 * 2/2007 Moyes ..... 166/305.1

OTHER PUBLICATIONS

Be. Paul Bercegeay, et al., "A One-Trip Gravel Packing System", SPE 4771; Feb. 1974; 12 pages.
Stephen P. Mathis; Sand Management: A Review of Approaches and Concerns; SPE 82240; May 2003; 7 pages.

* cited by examiner

*Primary Examiner*—Jennifer H Gay
*Assistant Examiner*—Cathleen R Hutchins
(74) *Attorney, Agent, or Firm*—Steve Rosenblatt

(57) ABSTRACT

A deflection device keeps high velocity gravel slurry flow from directly impinging the wellbore wall in open hole and breaking loose the filter cake coating on the wall or, in a cased hole, prevents the direct impingement of gravel slurry on the casing which can cause wear from erosion. The slurry exist from an intermediate annulus in a crossover that is fitted with movable members that can be pivotally mounted for rotational displacement by the pumped slurry to act as a deflector to prevent or minimize direct impingement on the wellbore wall or casing. When the flow stops the deflectors can pivot back to their original positions. The deflectors can be simply replaced when worn.

20 Claims, 2 Drawing Sheets

FRAC-PACK CASING SAVER

FIELD OF THE INVENTION

The field of this invention relates to gravel delivery systems involving crossovers where the delivery rates are elevated to compensate for highly unconsolidated formations.

BACKGROUND OF THE INVENTION

Gravel packing is the technique of depositing proppant or sand in perforations to promote production and to slow the production of particulates from the formation as the hydrocarbons are produced. In the case of unconsolidated formation with relatively high permeability, much of the fluid used to circulate the gravel can be absorbed by the formation when gravel is delivered. To compensate for this fluid loss and to be able to also frac the formation as the gravel is delivered, the pumping rate has been greatly stepped up. While operations in more consolidated formations could result in an adequate frac job with about 15 barrels a minute flow rate, flow rates in the order of 65 barrels per minute or more are not unusual when dealing with a fairly unconsolidated formation.

In a typical installation, the gravel slurry is delivered down the tubing and goes through a packer and into a cross-over and into an inner annulus. The slurry from there has to make a radial exit due to the equipment configuration to get to the outer annulus that is the wellbore. If the well is cased at that point the slurry exit velocities at the higher pumping rates required in unconsolidated formations has in the past caused erosion problems where the slurry makes initial impact after exiting the openings from the inner annulus, as illustrated in FIG. 4. Additionally, if the well is open hole, the high fluid velocities make the filter cake on the wellbore wall come off. This is also not desirable as the gravel and fluid would tend to go into the formation at that location rather than further along the wellbore. Alternatively the filter cake can plug the gravel pack and impede subsequent production.

The present invention addresses the harm from high pumping rates of gravel slurry in unconsolidated formations by deflecting the exiting gravel flow away from the casing or borehole wall to reduce or eliminate the erosive effects from high impact of slurry. The deflection device also acts to improve impingement angles downstream which also can reduce the erosion of the casing or the removal of filter cake in open hole. The deflecting device is simple to fabricate and takes the brunt of the erosion effects from high velocity slurry impinging it. These and other aspects of the present invention can be more readily understood from a review of the description of the preferred embodiment that appears below along with the associated drawings. The claims at the end of the application are understood to define the full scope of the invention.

SUMMARY OF THE INVENTION

A deflection device keeps high velocity gravel slurry flow from directly impinging the wellbore wall in open hole and breaking loose the filter cake coating on the wall or, in a cased hole, prevents the direct impingement of gravel slurry on the casing which can cause wear from erosion. The slurry exist from an intermediate annulus in a crossover that is fitted with movable members that can be pivotally mounted for rotational displacement by the pumped slurry to act as a deflector to prevent or minimize direct impingement on the wellbore wall or casing. When the flow stops the deflectors can pivot back to their original positions. The deflectors can be simply replaced when worn.

DETAILED DESCRIPTION OF THE PREFERRED EMBODIMENT

Figure 2:
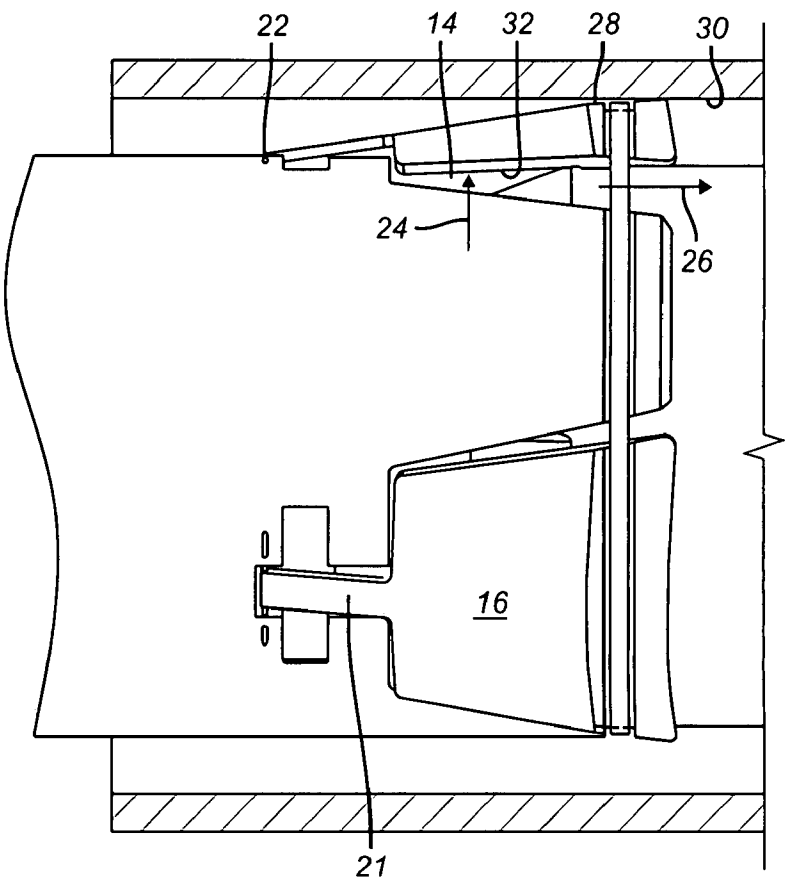
FIG. 2 is the view of FIG. 1 with the deflectors in the open position.
Figure 1:
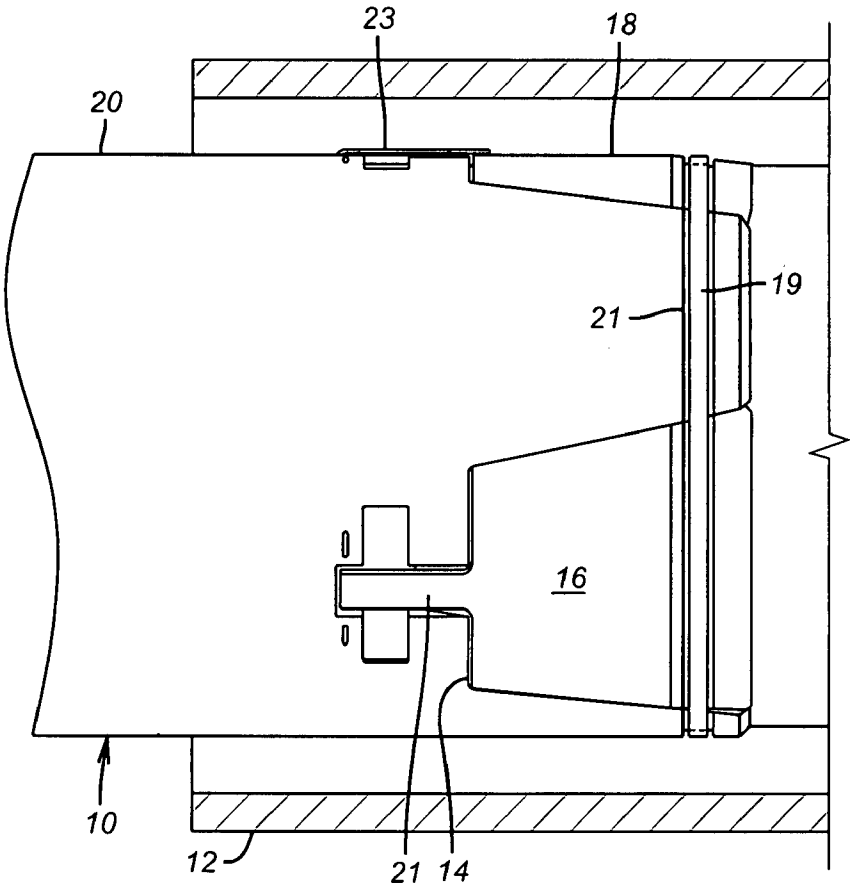
FIG. 1 shows the deflectors in a closed position inside of casing.
Figure 3:
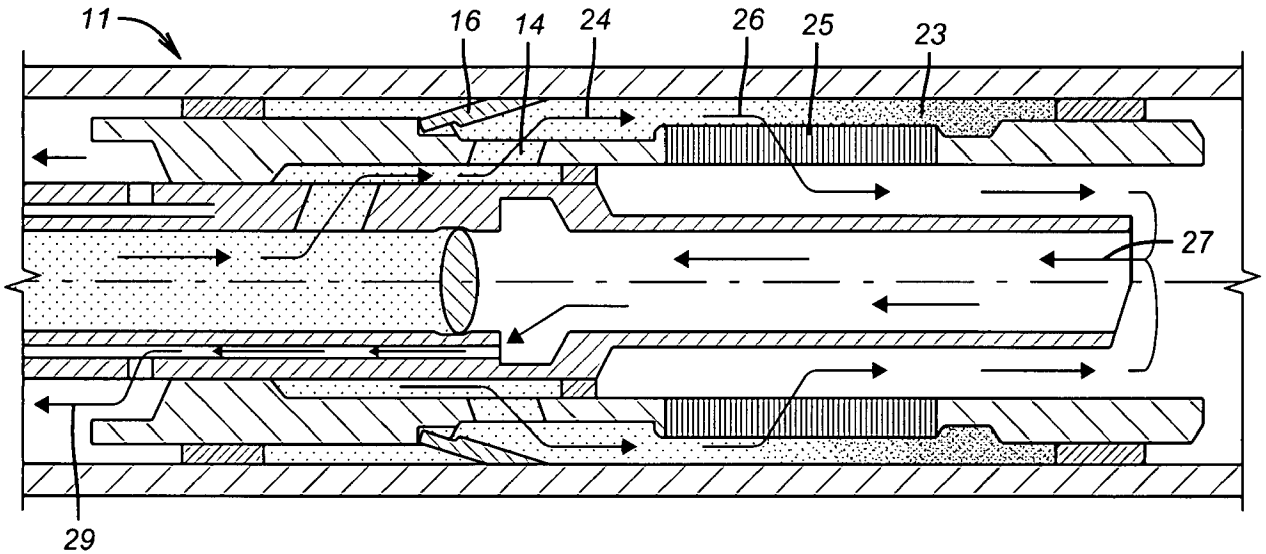
FIG. 3 shows a crossover with the deflector pushed open by flow.
Figure 5:
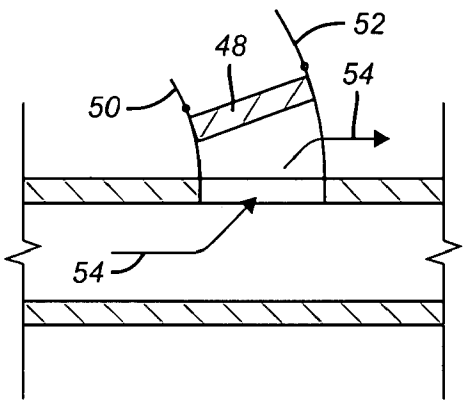
FIG. 5 is an alternative embodiment showing guides for uneven deflector movement from the opening with a slurry orientation downhole.
Figure 4:
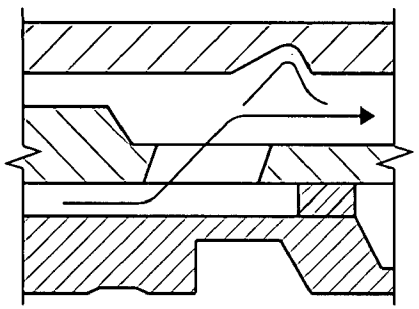
(PRIOR ART) FIG. 4
FIG. 4 shows the damage that can happen without the deflector at high slurry flow rates.

FIG. 1 illustrates a tubular shape 10 that defines the inner annulus from a crossover 11 shown in FIG. 3, through which the gravel slurry travels after coming down a tubing string (not shown) and through a packer (not shown). These components are omitted because they are well known to those skilled in the art and the Figures focus on the modification to such equipment that addresses the issue of erosion of a surrounding casing or wellbore, either of which is shown as 12 surrounding the tubular 10. Tubular 10 has one or a plurality of outlets 14 that are normally covered, when there is no slurry flow through the crossover, by deflection members 16. Preferably members 16 on their outer surface 18 take the curvature of the tubular 10 so that surface 18 becomes approximately the continuation of the outer surface 20 of the tubular 10. Deflection or diverter member 16 is preferably pivotally mounted at pin 22 that is more easily seen in FIG. 2. It can have a generally trapezoidal shape. Its own weight can keep it in the closed position of FIG. 1. Arrow 24 illustrates pumped slurry exiting opening 14 and striking the deflection member 16 in a generally radial direction. In response, the deflection member through a panhandle 21 pivots on pin 22 to allow the slurry flow represented by arrow 26 to change direction from generally radial at arrow 24 to generally axial and in approximately the direction of the wellbore wall 30. Those skilled in the art will appreciate that this reorientation of the slurry stream reduces or eliminates direct slurry impingement at high velocity in a nearly radial direction against the wellbore wall 30 regardless of whether that is filter cake from drilling in an open hole or the inner wall of a tubular or casing in a cased or lined borehole. The gravel 23 is left outside the screen 25 while the filtered fluid 27 returns to the crossover 11 as indicated by arrows 29.

Deflection members 16 may be made from a hardened material or coated with a hardened material to improve service life. The hardened material can cover the inside surface 32 and may be removable for rapid change without a need to replace the entire deflection member 16 which can then be made from a cheaper material. Carbide or composite materials could be used for a more durable surface that receives the impinging slurry flow.

Alternative designs are envisioned. The deflection members 16 can be fixedly mounted in a spaced relation to the openings 14 and can be mounted in such a way as to allow rapid replacement, when needed. It will be recognized that this alternative design enlarges the clearance needed to run the tool and further creates a potential for damage during run in. In the embodiment of FIGS. 1 and 2 the deflection devices 16 become a continuation of the outer surface 20 of the tubular 10. To insure that the deflection devices stay in the FIG. 1 position during run in a band spring 19 can be mounted on an exterior groove 21 on the deflection devices 16. Alternatively, a spring 23 can be fitted on the pin 22 akin to the application seen on flapper closures in subsurface safety valves. Yet another option is to hold the deflection members 16 shut for run in with a breakable member and simple start slurry pumping and use pump pressure to break the closure device so that pivoting action can occur.

For greater stability in the open position, outer face 28 on the deflection member 16 can be presented at an angle that promotes as close to a flush contact as possible with surface 30 considering the pivoting action about pin 22. Optionally, a seal member can be fitted to the edges of the deflection member 16 to prevent or minimize flow in either direction past the deflection member 16 when in the FIG. 1 position.

Yet another alternative design is to guide the deflection members 16 so that they may lay flush for run in as shown in FIG. 1 but under pressure from the slurry circulation pumps at the surface the deflection members 48 will move along guides 50 and 52 in a generally radial direction all around so that they don't cock at the wrong angle. While it is preferred that the deflection angle redirect the slurry flow in a downhole direction, see arrows 54, to reach the area of interest below the packer, a deflection device that is radially movable while still parallel to the tubular 10 will still protect the wellbore 12 but may allow some of the slurry to flow uphole. A fixed deflection device at a distance from the opening 14 should preferably be slanted to direct the slurry flow downhole along the wellbore wall 30. Even a guided design for the deflection member 16 can ensure that the downhole end moves more than the uphole end so as to approximate the performance of the pivoting design shown in FIGS. 1 and 2.

The above description is illustrative of the preferred embodiment and various alternatives and is not intended to embody the broadest scope of the invention, which is determined from the claims appended below, and properly given their full scope literally and equivalently.

I claim:

1. A gravel deposition tool for wellbore use within a surrounding tubular, comprising:

a housing defining an internal passageway with a port into a surrounding inner annulus and a selectively closable seat in said passageway below said port further comprising at least one opening from said inner annulus to allow an exit into an outer annulus formed between said housing and the surrounding tubular; and a diverter mounted adjacent said opening and to said housing to deflect a gravel-laden fluid stream passing through said opening away from the surrounding tubular wellbore.

2. The tool of claim 1, wherein:

said diverter is movably mounted.

3. The tool of claim 1, wherein:

said diverter is fixedly mounted.

4. The tool of claim 2, wherein:

said diverter is pivotally mounted.

5. The tool of claim 1, wherein:

said diverter comprises an outer surface substantially aligned with said housing when disposed in said opening.

6. The tool of claim 1, wherein:

said diverter is moved away from said opening by flow through said opening.

7. The tool of claim 1, wherein:

the weight of said diverter biases it into said opening.

8. The tool of claim 1, further comprising:

a biasing device to keep the diverter aligned with said opening.

9. The tool of claim 8, wherein:

said biasing device further comprises at least one band spring around said housing overlaying said diverter.

10. The tool of claim 8, wherein:

said diverter is pivoted on a pivot pin on said housing; and said biasing device comprises a spring mounted to said pin.

11. The tool of claim 3, wherein:

said diverter is angularly disposed with respect to said opening to redirect flow through said opening away from the wellbore wall.

12. A gravel deposition tool for wellbore use within a surrounding tubular, comprising:

a housing defining an inner annulus further comprising at least one opening to allow an exit into an outer annulus formed between said housing and the surrounding tubular; and a diverter mounted adjacent said opening and to said housing to deflect a gravel-laden fluid stream passing through said opening away from the surrounding tubular wellbore;

said diverter is movably mounted;

guides for said diverter that allow movement of different amounts at opposed ends to position said diverter angularly and away from said opening to redirect flow through said opening away from the wellbore wall.

13. The tool of claim 1, further comprising:

a harder layer on the inside of the diverter that is positioned for receiving the initial contact of flow through said opening.

14. The tool of claim 13, wherein:

said harder layer is removably mounted.

15. The tool of claim 4, wherein:

said diverter comprises an outer surface segment designed to be in substantial alignment with the wellbore wall upon contacting it.

16. The tool of claim 1, wherein:

said diverter comprises a generally trapezoidal shape with a panhandle extending from the shorter substantially parallel side to a pivot pin connection.

17. The tool of claim 4, wherein:

said diverter comprises an outer surface substantially aligned with said housing when disposed in said opening.

18. The tool of claim 17, wherein:

said diverter is moved away from said opening by flow through said opening.

19. The tool of claim 18, wherein:

the weight of said diverter biases it into said opening.

20. The tool of claim 19, wherein:

a harder layer on the inside of the diverter that is positioned for receiving the initial contact of flow through said opening.

* * * * *